US006705615B2

(12) United States Patent
Milberger et al.

(10) Patent No.: US 6,705,615 B2
(45) Date of Patent: Mar. 16, 2004

(54) SEALING SYSTEM AND METHOD

(75) Inventors: Lionel J. Milberger, Houston, TX (US); Larry E. Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 50 days.

(21) Appl. No.: 10/003,875

(22) Filed: Oct. 31, 2001

(65) Prior Publication Data

US 2003/0080515 A1 May 1, 2003

(51) Int. Cl.[7] ..... E21B 33/00

(52) U.S. Cl. ..... 277/328; 277/329; 277/330; 166/182

(58) Field of Search ..... 166/182, 208; 277/328, 329, 330

(56) References Cited

U.S. PATENT DOCUMENTS

| | | | |
|---|---|---|---|
| 4,702,481 | A | 10/1987 | Brammer |
| 4,719,971 | A | 1/1988 | Owens |
| 4,757,860 | A | 7/1988 | Reimert |
| 4,771,832 | A | 9/1988 | Bridges |
| 4,823,871 | A | 4/1989 | McEver et al. |
| 4,911,245 | A | 3/1990 | Adamek et al. |
| 5,067,734 | A | 11/1991 | Boehm, Jr. |
| 5,076,356 | A | 12/1991 | Reimert |
| 5,110,144 | A | 5/1992 | Burton et al. |
| 5,333,692 | A | 8/1994 | Baugh et al. |
| 5,355,961 | A | 10/1994 | Gariepy et al. |
| 5,375,812 | A | 12/1994 | Kent |
| 5,511,620 | A | 4/1996 | Baugh et al. |
| 5,685,369 | A | 11/1997 | Ellis et al. |

FOREIGN PATENT DOCUMENTS

| | | |
|---|---|---|
| GB | 2 217 795 A | 12/1988 |
| GB | 2356210 | 5/2001 |

*Primary Examiner*—Anthony Knight
*Assistant Examiner*—Enoch Peavey
(74) *Attorney, Agent, or Firm*—Loren G. Helmreich; Browning Bushman, P.C.

(57) ABSTRACT

A sealing system for sealing with a generally cylindrical surface 52 of a tubular or another tool 50 includes an annular packer element 10, a wedge ring 60 having a substantially conical outer surface 62 configured to radially expand the packer element, and a positioner 40 for moving one of the packer element and wedge ring relative to the other packer element and wedge ring. The packer element 10 includes an first elastomeric seal body 20 axially supported on a first metal rib 14 extending radially from a metal base 12, and a second seal body 22 axially supported on a second metal rib 16. The second seal body 22 has an elasticity lower than that of the first seal body. According to the method of the invention, the positioner is moved to cause the first seal body 20 to sealingly engage the cylindrical surface, and hydraulic forces due to that sealing engagement then move the packer element to the expanded diameter sealing position, in which the second seal body 22 seals against the cylindrical surface.

42 Claims, 4 Drawing Sheets

SEALING SYSTEM AND METHOD

FIELD OF THE INVENTION

The present invention relates to a sealing system which uses a radial set packer element for sealing with a wellhead, tubular, or other tool having an interior cylindrical surface. More particularly, this invention relates to a packer element which is configured to achieve an initial seal between a wedge ring and the cylindrical surface with an first elastomeric seal body, so that the subsequent application of fluid pressure results in the seal element moving further relative to the wedge ring to sealingly engage a second seal body, which has a lower elasticity than the first seal body, with the cylindrical surface. In response to fluid pressure, both the second seal body and one or more radial extending ribs of the packer element may be moved into sealing engagement with the cylindrical surface, thereby forming a reliable high pressure and/or high temperature seal.

BACKGROUND OF THE INVENTION

Annular seal assemblies, also called packer elements, have been used to seal between a wedge ring having a conical outer surface and a cylindrical sealing surface. A positioner, which in some applications is a conveyance tubular for lowering the packer element into the well, is manipulated axially either to move the packer element relative to the wedge ring, or to move the wedge ring relative to the packer element, thereby radially expanding the diameter of the packer element from an initial reduced diameter position to an expanded diameter sealing position.

U.S. Pat. Nos. 4,757,860 and 5,076,356 disclose radial set packer elements which may be used in various applications, including a subsea wellhead. U.S. Pat. Nos. 5,511,620 and 5,333,692 disclose packer elements intended for sealing between a liner hanger and a casing. Other types of packer elements are disclosed in U.S. Pat. Nos. 5,685,369, 5,375,812, 5,110,144, 5,067,734, 4,911,245, 4,823,871, 4,771,832, and 4,719,971.

In a subsea wellhead application, an annular seal assembly or packer element has thus been used to seal the annulus between the cylindrical inner surface of the wellhead housing and the conical or tapered outer surface on the wedge ring of the casing hanger. The packer element is conventionally run-in with a tool which also carries and lands the casing hanger within the wellhead housing. The tool may be manipulated by setting weight down on the tool to cause the packer element to radially expand and seal between the tapered wedge ring surface of the casing hanger and the cylindrical interior surface on the wellhead. After the packer element is set by this manual procedure, the blowout preventer (BOP) may then be closed around the drill pipe to increase fluid pressure applied above the packer element through choke and kill lines. This fluid pressure increase causes the packer element to further move down the taper of the wedge ring on the casing hanger. After the packer element is fully set and landed on top of the casing hanger, fluid pressure may be applied to test the integrity of the packer element at the intended working pressure of the wellhead system.

Conventional packer elements have performed reasonably well in subsea systems at normal temperatures to about 250° F. In many applications, however, packer elements are intended to seal at elevated temperatures of 350° F. or higher, particularly during production operations subsequent to drilling operations. Conventional packer elements with elastomeric seal bodies cannot reliably seal at sustained temperatures of 350° F. or higher. Elastomeric material seal bodies have undesirable properties, such as high thermal expansion, high compression, high temperature degradation, and degradation in the presence of conventional drilling and/or production fluids. Also, conventional elastomeric seal bodies do not reliably seal against high pressure gas commonly produced from many wells.

If an all-metal packer element is used, the undesirable properties of the elastomer are avoided. However, it is difficult for an all-metal radial set packer element to achieve an initial seal during the setting operation. It is difficult and expensive to create the high forces required to reliably bring an all-metal radial set packer element into sealing engagement. Moreover, high set down forces may not be available due to limited drill pipe lengths in shallow wells. Due to the disadvantages of the all-metal packer elements, increased emphasis has been placed during the past decade or more to reduce the undesirable properties of the elastomeric seal bodies. While a change in the elastomeric seal body material has helped in some applications, many applications continue to use packer elements with elastomeric seal bodies, and take other measures to try to minimize the detrimental properties of those seal bodies. The effort to reduce the undesirable properties of elastomeric material seal bodies in packer elements has produced limited success, particularly in high temperature and/or high pressure applications.

The disadvantages of the prior art are overcome by the present invention. An improved sealing system is hereinafter disclosed with a radial set packer element which uses a positioner to form an initial seal with an first elastomeric seal body, so that fluid pressure forces may be subsequently used to move the packer element to its expanded diameter sealing position, wherein a second seal body and optionally one or more metal ribs form a reliable seal with the interior cylindrical surface.

SUMMARY OF THE INVENTION

In a suitable subsea wellhead application, the sealing system of the present invention seals between the generally interior cylindrical surface of the wellhead and the wedge ring of a casing hanger positioned within the wellhead. The axially extending packer element includes a first seal body axially supported on a first metal rib (seal support) extending radially from a metal base, with the first seal body having an outer diameter for initial engagement with the interior cylindrical surface of the wellhead. A second seal body is axially supported on a second metal rib (seal support), with a second seal body being formed from a tin alloy or other material having a lower elasticity than the first seal body. The wedge ring on the casing hanger has a substantially conical outer surface configured to radially expand the packer element from a reduced diameter initial position to an expanded diameter sealing position. A positioner moves either the packer element or the wedge ring relative to the other of the packer element and wedge ring, such that the positioner causes the elastomeric first seal body to initially seal with the interior cylindrical surface. Due to the sealing engagement of the first seal body with the sealing surface, hydraulic forces and/or mechanical forces created by the hydraulic forces further moves the packer element with respect to the wedge ring to bring the second seal body into sealing engagement with the interior cylindrical surface. If desired, hydraulic forces may also be used to bring one or more metal ribs into sealing engagement with the cylindrical surface.

It is an object of the present invention to provide a sealing system with an improved radial set seal element which has an elastomeric seal body which creates an initial seal to assist in moving the seal element to its expanded diameter position, such that a second seal body with a lower elasticity then engages the interior cylindrical sealing surface. According to the method of the present invention, a set-down weight may be applied by a positioner for moving the seal element to form an initial seal between the first elastomeric seal body and the cylindrical interior surface. In one subsea wellhead application, the BOP may then be closed around the drill pipe and pressure applied through choke and kill lines to exert a hydraulic force on the initially set packer element to move the packer element to its expanded diameter sealing position. In another application, once the first elastomeric seal body seals with the cylindrical interior surface, the BOP may be closed and hydraulic force converted by an intensifier to a substantial mechanical force to push the packer element to its expanded diameter sealing position.

It is a further object of the present invention that at least some of the forces used to move the seal element to its fully expanded diameter sealing position are exerted by hydraulic pressure created after the elastomeric seal body initially engages the cylindrical surface.

It is a feature of the invention that the packer element may be moved to its expanded diameter sealing position by positioning the first elastomeric seal body below the second seal body, such that the first seal body effectively pulls the sealing element downward along the taper of the wedge ring and to the expanded diameter sealing position. A related feature of the invention is that the first elastomeric seal body is not required to maintain a seal with the cylindrical sealing surface after the second seal body has been moved into sealing engagement with the cylindrical surface. It is thus acceptable that the first elastomeric seal body may become disabled after the setting operation is complete, provided that the disabled first seal body does not interfere with the performance of the second seal body.

A still further feature of the invention is that the packer element may be provided with metal ribs which extend outwardly from a metal base, such that the metal ribs support the seal bodies to prevent extrusion, and also may form a reliable metal-to-metal seal with the cylindrical surface after sealing engagement of the second seal body.

Another significant feature of the invention is that a relatively low set-down weight may be used to initially set the first elastomeric seal body, thereby avoiding the cost and reliability problems associated with using a high set-down forces, which may not be available due to limited drill pipe lengths in shallow wells.

Yet another feature of the invention is that the elastomeric seal body may have an initial outer diameter which is less than the internal cylindrical surface, so that the packer element may engage the cylindrical surface only after some radial expansion of the packer element due to axial movement of the packer element relative to the wedge ring.

It is a particular feature of the present invention that the packer element may form a reliable high pressure seal for operating at a temperature of at least 350° F. between an inner cylindrical surface of a tubular or another tool and a wedge ring radially inward of the packer element.

Yet another feature of the invention is that the packer element is configured such that high temperatures do not cause high pressure buildup between the radial extending ribs of the packer element.

An advantage of the invention is that the sealing system may be used in various applications, including sealing between a cylindrical internal surface on a subsea wellhead and a wedge ring on a casing hanger, or between the internal cylindrical surface of a surface wellhead and a casing hanger, or between a casing and a liner hanger, or between a tubing hanger and a wellhead hanger. In each application, an outer tubular is connected to the internal cylindrical surface to be sealed, which may be part of a tubular or another tool, such as a wellhead assembly. The wedge ring is configured to radially expand the packer element from a reduced diameter initial position to the expanded diameter sealing position. The wedge ring accordingly may be interconnected with another smaller diameter tubular, so that the packer element effectively forms a seal between the outer tubular and the inner tubular.

A significant advantage of the present invention is that the packer element may be reliably used in high temperature applications of 350° F. or more and/or in high pressure applications. Also, the packer element need not use exotic elastomeric materials which have reduced undesirable properties, since the elastomeric seal body is not relied upon to maintain sealing engagement once the packer element is expanded to its sealing position. The second seal body may be formed from various materials having a lower elasticity than the first seal body, including tin, tin alloys, metals softer than the metal base of the packer element, relatively hard elastomeric materials, and plastic materials.

These and further objects, features, and advantages of the present invention will become apparent from the following detailed description, wherein reference is made to the figures in the accompanying drawings.

DETAILED DESCRIPTION OF THE PREFERRED EMBODIMENT

Figure 1:
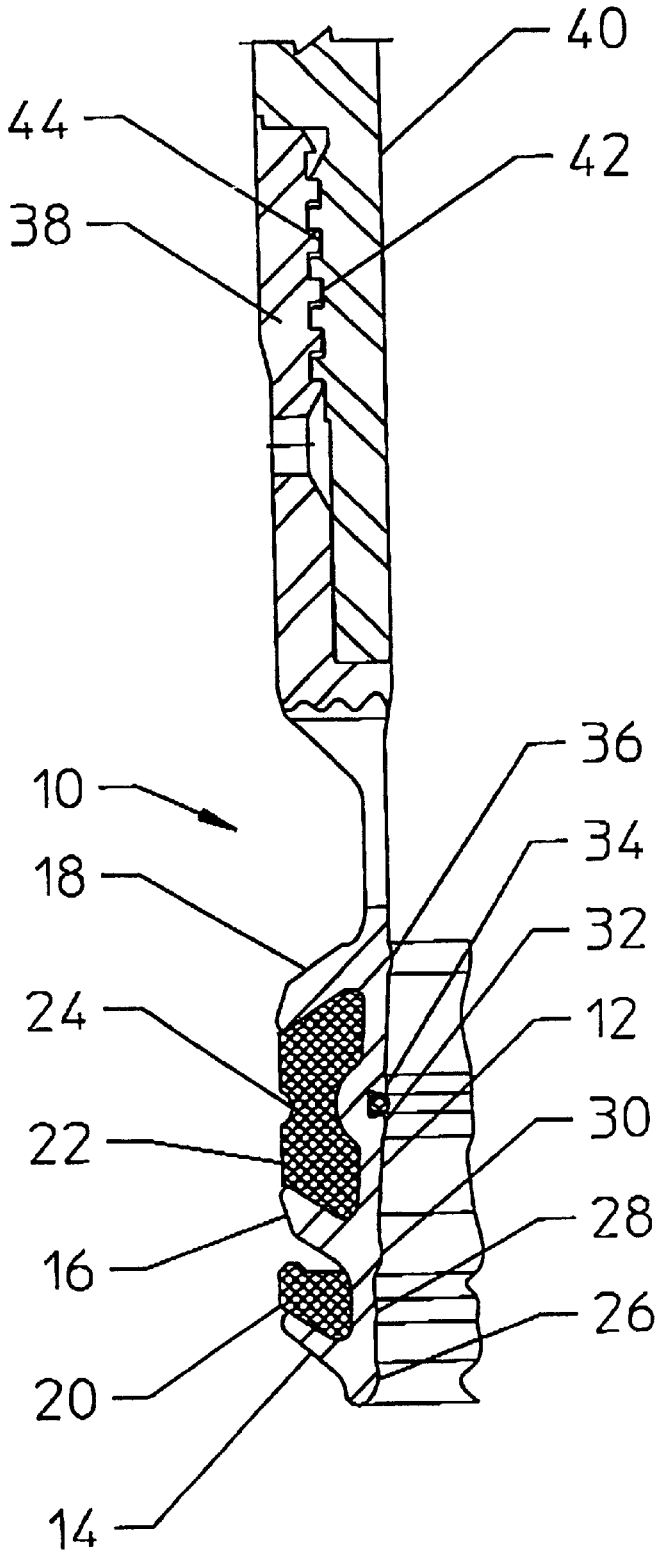
FIG. 1 illustrates an annular packer element according to the present invention supported on a positioner.
Figure 2:
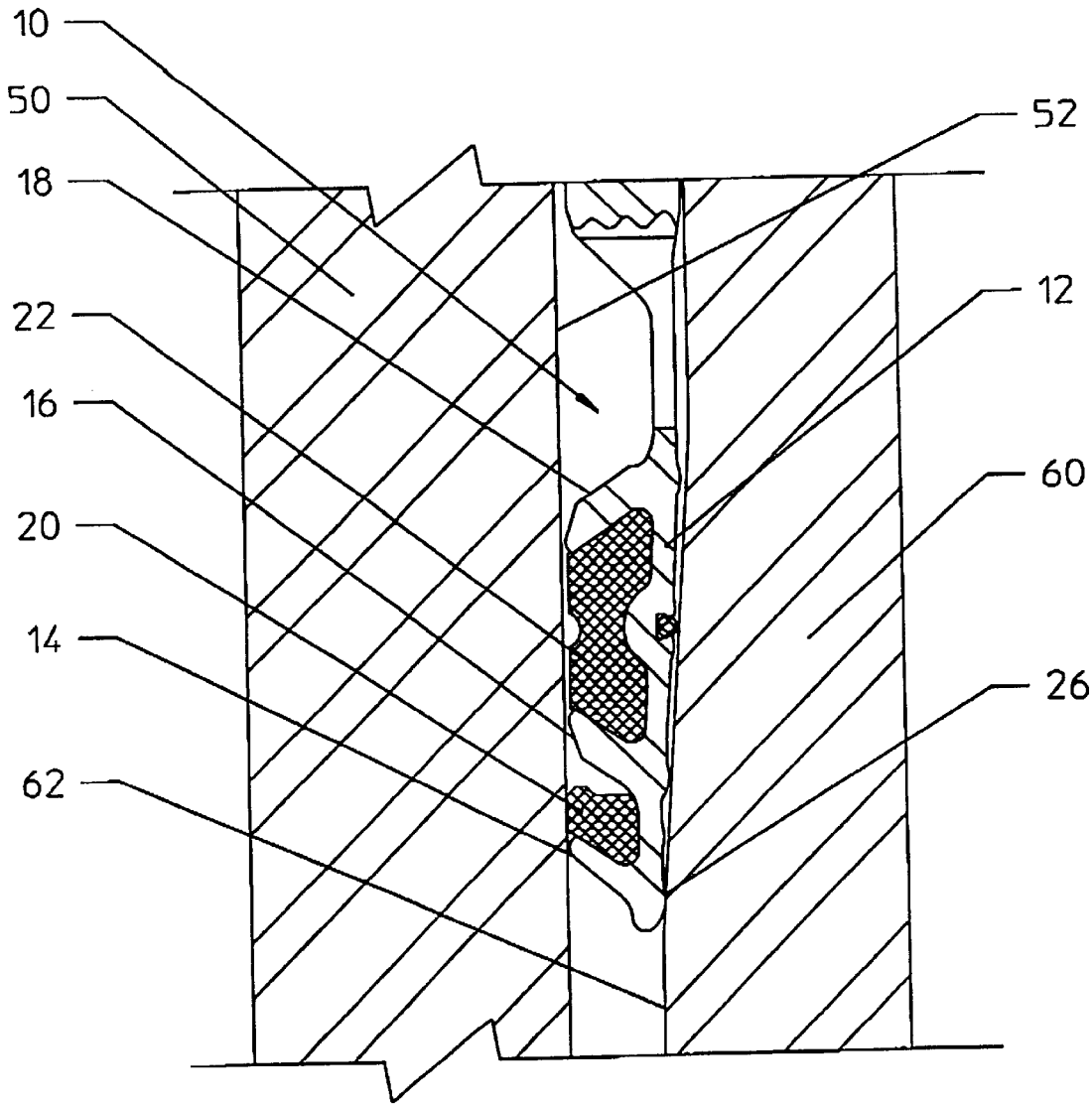
FIG. 2 illustrates the packer element moved into initial engagement with a cylindrical interior surface of a wellhead and the wedge ring of a casing hanger.

FIG. 1 depicts a packer element 10 having a connector body 38 with internal threads 42 for engagement with external threads 44 on a positioner 40. In the disclosed embodiment, the positioner 40 moves the packer element 10 axially downward with respect to the stationary wedge ring 60, as shown in FIG. 2, although alternatively the positioner may move the wedge ring axially with respect to a stationary packer element. Those skilled in the art will appreciate that the positioner 40 may have a tubular body which is manipulated or moved axially to move the packer element 10 relative to the wedge ring 60 to obtain an initial seal, as explained subsequently. Those skilled in the art will appreciate that the positioner 40 in the subsea wellhead application may exert an axial force of 10,000 pounds or more on the packer element.

The packer element 10 includes a metal base 12 and metal fingers or ribs 14, 16, and 18 each extending radially outward from the base 12. In the FIG. 1 embodiment, the lowermost rib 14 supports a first elastomeric annular seal body 20. A second annular seal body 22 as shown is sandwiched between an upper downwardly extending rib 18 and a lower upwardly extending rib 16. When fluid pressure is applied above the packer element, the elastomeric seal body 20 is supported on the upwardly extending rib 16. Both ribs 14 and 16 thus act as seal body supports when pressure is from above, and a rib 18 acts as a seal body support when pressure is from below. The seal body 20 may have the same initial diameter of seal body 22, but first engages the cylindrical interior surface 52 (see FIG. 2) due to the taper of the cone surface 62. Seal body 22 is shown with an annular groove 24. One or both of the seal bodies may be provided with annular grooves to increase the number of sealing surfaces, and to provide void areas for thermal expansion of the respective seal body. In a preferred embodiment as shown in FIG. 1, seal body 20 is formed from elastomeric or rubber-like material which has a high elasticity, while the seal body 22 is formed from a tin or tin alloy which has a lower elasticity. The more elastic seal body 20 is softer than the less elastic seal body 22, so that the seal body 20 is easily compressed to first sealingly engage the interior cylindrical surface. Preferably the annular groove formed by the ribs 14, 16, and 18 provides an axial length and a radial thickness for receiving a large seal body 20 and 22 to bridge or fill in any defects in the interior cylindrical surface. Also, the depth of the groove formed by the ribs 14, 16 and the base 12 is relatively deep, and may provide a radial depth for a second seal body which is at least 70 percent, and preferably at least 75 percent, of the annular gap between the cylindrical surface and the wedge ring when the packer element is in the fully expanded position, as explained subsequently. The first seal body 20 similarly has a radial thickness of at least 70 percent of the annular spacing between the cylindrical surface and the conical surface when the packer element is fully set.

The base 12 of the packer element and the majority of each of the fingers 14, 16, 18 may be formed from conventional metals, such as steel, having a yield strength of 80 ksi (80,000 psi). If desired, the tip ends of one or more of the ribs 14, 16, 18 may be overlaid with a softer material, which may have a yield strength of about 30 ksi. One or more grooves may be cut in the O.D. of finger 14, 16 or 18 to increase the number of metal surfaces which are in metal-to-metal contact with the cylindrical sealing surface. The material for the second body seal 22, which may be a tin, a tin alloy, lead, lead alloy, indium, indium alloy, cast iron, or any other metal softer than that of the metal base 12, plastic or an elastomer which, as explained above, has a lower elasticity than that of the first seal body 20. For some applications, PEEK may be a suitable plastic material for the second seal body 22. The material for the seal body 22 is, however, relatively soft compared to the metal fingers, and preferably has a yield strength less than 20 ksi, and more preferably less than 10 ksi.

Packer element 10 as shown in FIG. 1 thus seals against the cylindrical surface 52 of the wellhead 50 which, as explained above, may be a surface or subsurface wellhead, or may be an outer tubular, such as a casing, or may be another tool. Packer element 10 as shown in FIG. 1 may seal with the wedge ring 60 which, in a subsea wellhead application, is a component of a casing hanger. In a liner hanger application, the packer element may seal between the wedge ring of the liner hanger and the casing.

To achieve sealing engagement with the conical surface 62 of the wedge ring 60 as shown in FIG. 2, the packer element 10 is provided with a series of axially spaced protrusions 26, 28, 30, 32, 34, and 36 for providing redundant metal-to-metal sealing engagement with the wedge ring 60. If desired, one or more elastomeric seals, such as O-ring seal 46, may also be provided for sealing engagement between the base 12 of the packer element and the surface 62 of the wedge ring.

Figure 3:
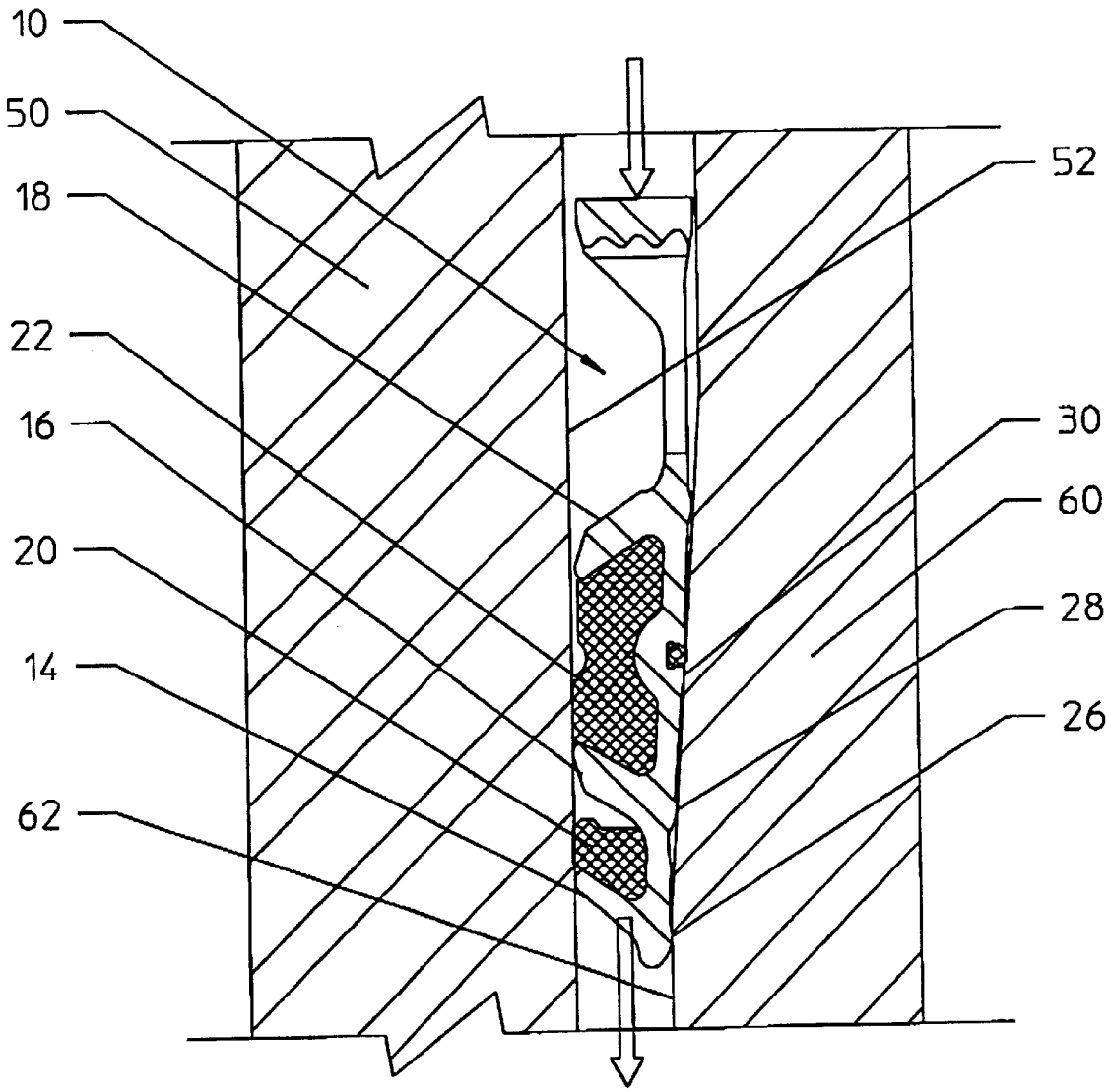
FIG. 3 illustrates the packer element moved into position such that the first seal body and the second seal body are in sealing engagement with the wellhead.

FIG. 2 depicts the packer element 10 wherein at least the lowermost protrusion 26 has engaged the tapered surface 62 on the wedge ring 60 and has initially expanded the wedge ring so that the elastomeric first seal body 20 is moved into sealing engagement with the cylindrical surface 52. In its initial run-in, the packer element 10, including the seal body 20, preferably has a diameter less than that of the internal cylindrical surface. As previously indicated, the motion required to move the packer element relative to the wedge ring may be transmitted by a setting force or a "set down" force applied through the positioner 40 to one of the packer element 10 or the wedge ring 60 and, for the embodiment discussed herein, to the packer element 10 relative to an otherwise stationary wedge ring 60. At the stage shown in FIG. 2, none of the ribs 14, 16, or 18 need be in sealing engagement with the cylindrical surface 52, and the second seal body 22 may still be spaced slightly from the cylindrical surface 52. A predetermined set down force may, however, bring the lowermost rib 14 into engagement (although likely not sealing engagement) with the surface 52, thereby slightly bending the rib 14 toward the base 12, and providing a reliable indication to the operator that the seal body 20 is in sealing engagement with surface 52. When in the position as shown in FIG. 2, fluid pressure transmitted from above, e.g., by closing the BOP and thus increasing the pressure between the wellhead 50 and the wedge ring 60 above the sealing element 10, may thus exert a hydraulic downward force on the element 10 to pull the packer element to the position as shown in FIG. 3. Hydraulic forces may thus be used to move the packer element 10 so that two or more of the protrusions on the base 12 are in sealing engagement with the wedge ring 60, and the outer diameter of the second seal body 22 comes into sealing contact with the interior cylindrical surface 52, as shown in FIG. 3.

At least in part due to the hydraulic forces acting on the packer element 10, the packer element thus moves axially relative to the wedge ring 60 until an exterior surface of the second seal body 22 sealingly engages the cylindrical surface 52 of the wellhead assembly 50. Initially some leakage past the second seal body 22 may occur, so that pressure continues to act on the lower seal body 20 to move the packer element further down the wedge ring and enhance sealing engagement of the second seal body 22 with the interior cylindrical surface. Once the second seal body 22 is moved into sealing engagement with the surface 52 of the wellhead assembly, fluid pressure above the seal body 22 may force the packer element 10 further downward relative to the wedge ring 60. The entire outer surface of seal body 22 as shown in FIG. 3 need not sealingly engage the cylindrical surface 52. As shown in FIG. 3, the outer surfaces of each of the support ribs 14 and 16 may be in physical contact with but not yet in sealing engagement with the surface 52.

Figure 4:
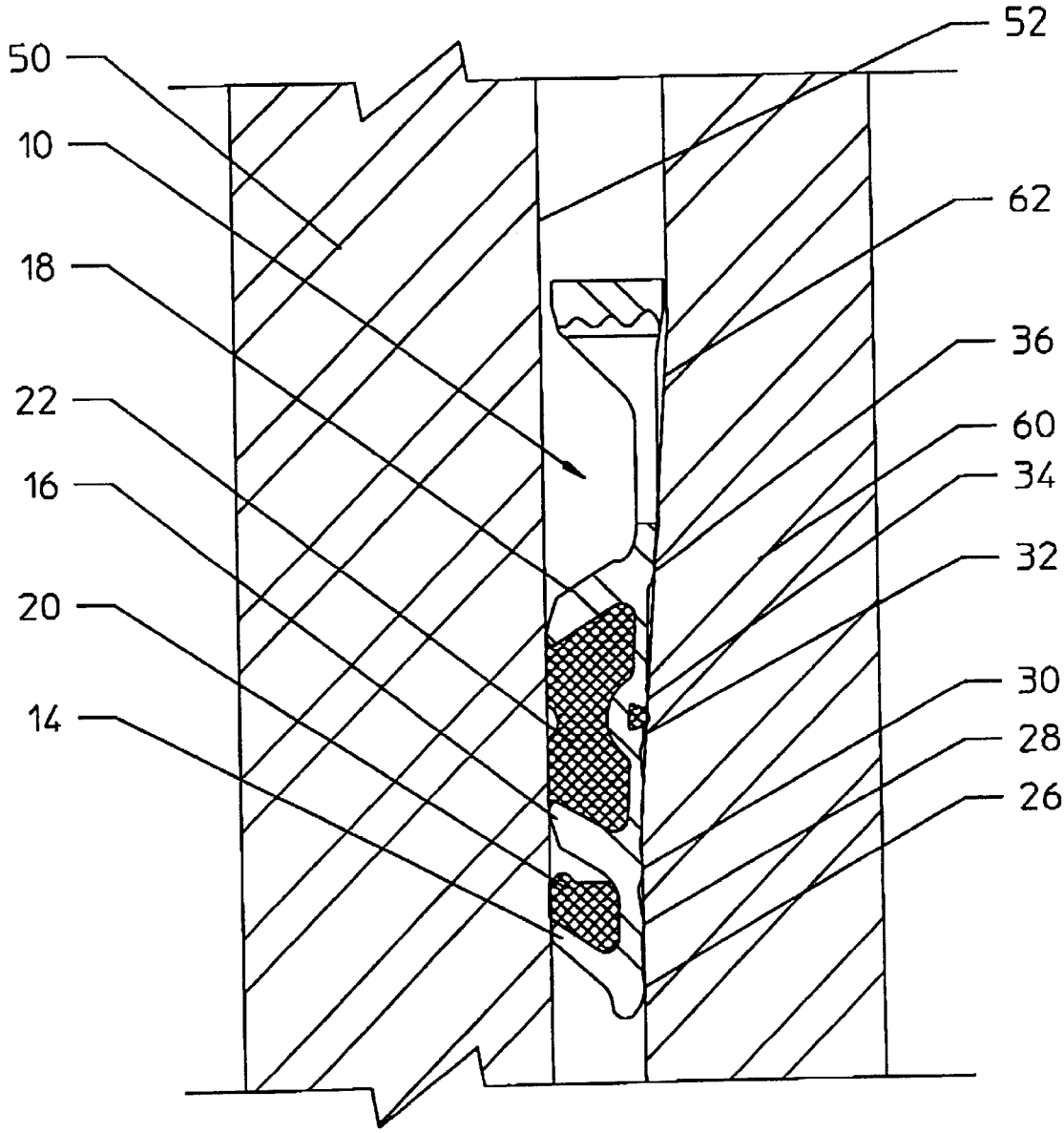
FIG. 4 illustrates the packer element moved to its expanded diameter sealing position, with both the second seal body and the metal ribs of the packer element in sealing engagement with the interior cylindrical surface of the wellhead.

Once the seal body 22 is moved into sealing engagement with the surface 52 of the wellhead assembly, another embodiment relies upon fluid pressure above the seal body acting upon an intensifier which, due to differing piston areas, produces a substantial downward force on the positioner 40 to force the packer element 10 further down the taper of the wedge ring 60. Thus hydraulic forces acting on the lower seal body 20 may effectively "pull" the packer element downward, while the fluid pressure created by the sealing engagement of body 20 with surface 52 acts on the intensifier to produce a substantial downward force which "pushes" the packer element downward. A combination of the pulling and pushing forces may be used to fully set the packer element. The extent of the force required to move the packer element 10 to its fully expanded sealing position, as shown in FIG. 4, will primarily depend upon the selected material for the seal body 22, and whether sealing engagement is desired between the ends of the ribs and the interior cylindrical surface. The harder the material of body 22, the more force will be required to press the packer element downward so that the harder seal body sealingly engages the interior cylindrical surface.

A primary purpose for the ribs 14, 16 and 18 is to support the respective seal body 20 and 22 during fluid pressure forces, and to minimize the likelihood of significant extrusion of the seal body past the metal rib in response to high fluid pressure forces. A primary purpose of the top rib 18 is to capture and contain the seal body 22, and to push the seal body 22 downward during the initial setting operation, and to support the seal body 22 when pressure is from below the packer element. Once hydraulic forces are acting on the seal body 22 to further move the packer element downward, it is assumed that fluid pressure will pass by the upper downwardly inclined rib 18.

The continued downward movement of the packer element thus results in the packer element 10 reaching the position as shown in FIG. 4, which is its final or expanded sealing position. In this position, two or more of the axially spaced protrusions 28, 30, 32, 34 and 36 preferably are in metal-to-metal sealing engagement with the tapered surface 62 of the cone or wedge ring 60. Once in this position, the elastomeric material of the first seal body 20 may degrade due to the previously discussed properties of elastomeric materials, but reliable sealing engagement is maintained due to the seal body 22 and, for the FIG. 4 embodiment, the metal-to-metal sealing engagement of the tip end of the ribs 14 and 16 with the cylindrical surface 52.

Once in its final sealing position as shown in FIG. 4, the packer element 10 may be mechanically locked to the wedge ring 60, so that fluid pressure above the set packer element may be released and the packer element maintained in its fully expanded position as shown in FIG. 4. Also, once in its fully expanded sealing position, the first elastomeric seal body 20 may degrade and lose its sealing function with the interior cylindrical surface, but this is permitted since the second seal body 22 is now in sealing engagement with the interior cylindrical surface. In one application, the taper of the wedge ring 60 may stop before the lowermost portion of the packer element 10 when in its fully expanded position, although preferably the protrusions 30, 32, 34 and 36 are in sealing engagement with the tapered surface of the wedge ring. Protrusions 26 and 28 thus need not be supported by the tapered surface of the wedge ring when the packer element is in its fully expanded sealing position, since the seal body 24 rather than the seal body 20 is relied upon to maintain sealing engagement with the interior cylindrical surface.

Those skilled in the art will appreciate that the packer element of the present invention thus provides a highly reliable high pressure and/or high temperature seal, which may be actuated with a relatively low mechanical setting force supplied to the tool positioner, with hydraulic forces created by the seal body 20 then producing the forces required to move the packer element from the initial reduced diameter position to its expanded sealing position. The packer element 10 and the sealing system of the present invention may thus be used between a casing hanger and a wellhead, or may be used between a liner hanger and a casing, or may be used in any other application where the larger diameter tubular has a cylindrical inner surface which is intended to be a sealing surface, and an inner tubular is connected to a wedge ring which has a substantial conical outer surface configured to radially expand the packer element to the expanded sealing position upon axial movement of the packer element relative to the wedge ring. The wedge ring may thus be interconnected with an inner tubular, and the set packer element reliably seals between the outer tubular and the inner tubular.

It will be understood by those skilled in the art that the embodiment shown and described is exemplary and various other modifications may be made in the practice of the invention. Accordingly, the scope of the invention should be understood to include such modifications which are within the spirit of the invention.

What is claimed is:

1. A sealing system for sealing with a generally interior cylindrical surface of a tubular or a tool, the sealing system comprising:

an axially extending annular packer element including a metal base, and a first elastomeric seal body spaced axially from a second seal body, the first seal body having an outer diameter for initially sealing with the cylindrical surface, the second seal body having an elasticity lower than the first seal body, the annular packer element having a reduced diameter initial position and an expanded diameter sealing position;

a wedge ring radially inward of the packer element and having a substantially conical outer surface configured to radially expand the packer element to the expanded sealing position upon axial movement of the packer element relative to the wedge ring; and a positioner for moving one of the packer element and the wedge ring relative to the other of the packer element and the wedge ring, the positioner initially sealing the first elastomeric seal body with the cylindrical surface.

2. The sealing system as defined in claim 1, wherein hydraulic forces due to the sealing engagement of the first seal body with the cylindrical surface further move the packer element with respect to the wedge ring to bring the second seal body into sealing engagement with the interior cylindrical surface.

3. The sealing system as defined in claim 1, wherein the second seal body is formed from one of a group consisting of tin, tin alloy, lead, lead alloy, indium, indium alloy, a metal softer than the metal base of the packer element, cast iron, plastic, and an elastomer having a substantially lower elasticity than the first seal body.

4. The sealing system as defined in claim 1, wherein the first elastomeric seal body is positioned axially below the second seal body, such that fluid pressure above the packer element acts to pull the packer element downward to sealingly engage the second seal body with the cylindrical interior surface.

5. The sealing system as defined in claim 1, wherein the positioner moves the packer element axially relative to a generally stationary wedge ring.

6. The sealing system as defined in claim 1, wherein the positioner moves the wedge ring axially relative to a generally stationary packer element.

7. The sealing system as defined in claim 1, further comprising:

the first seal body axially supported on a first metal rib extending radially from a metal base; and the second seal body axially supported on a second metal rib extending radially from the metal base.

8. The sealing system as defined in claim 7, wherein at least one of the first rib and the second rib sealingly engages the cylindrical interior surface after the second seal body.

9. The sealing system as defined in claim 1, wherein the second seal body is spaced axially between an upper metal rib and a lower metal rib.

10. The sealing assembly as defined in claim 9, wherein the upper metal rib is downwardly inclined, and the lower metal rib is upwardly inclined.

11. The sealing system as defined in claim 1, wherein the second seal body includes at least one groove extending radially from an outer diameter of the second seal body toward the metal base.

12. The sealing system as defined in claim 1, further comprising:

one or more axially spaced protrusions on a radially inner surface of the metal base each for metal-to-metal sealing engagement with the substantially conical outer surface of the wedge ring.

13. The sealing system as defined in claim 12, further comprising:

one or more annular elastomeric sealing members for sealing between the metal base and the conical outer surface of the wedge ring.

14. The sealing system as defined in claim 1, wherein the tool is a wellhead assembly with the interior cylindrical surface.

15. A method as defined in claim 1, wherein each of the first and second seal bodies is axially fixed in at least one direction by the metal base.

16. A method as defined in claim 15, wherein the second seal body is secured axially in both directions to the metal base.

17. A method as defined in claim 15, wherein the base includes radially extending fingers to limit axial movement of each of the first and second seal bodies with respect to the base in at least one direction.

18. A sealing system for sealing with a generally interior cylindrical surface of a tubular or a tool, the sealing system comprising:

an axially extending annular packer element including a metal base, and a first elastomeric seal body spaced axially from a second seal body, the first seal body having an outer diameter for initially sealing with the cylindrical surface, the second seal body formed from one of a group consisting of tin, tin alloy, lead, lead alloy, indium, indium alloy, a metal softer than the metal of the base of the packer element, cast iron, plastic, and an elastomer having an elasticity lower than the first seal body, the annular packer element having a reduced diameter initial position and an expanded diameter sealing position;

a wedge ring radially inward of the packer element and having a substantially conical outer surface configured to radially expand the packer element to the expanded sealing position upon axial movement of the packer element relative to the wedge ring, such that the second seal body sealingly engages the cylindrical surface; and a positioner for moving one of the packer element and the wedge ring relative to the other of the packer element and the wedge ring, the positioner initially sealing the first elastomeric seal body with the cylindrical surface, the first elastomeric seal body being positioned axially below the second seal body, such that fluid pressure above the packer element due to sealing engagement of the second seal body with the cylindrical interior surface results in a downward force on the packer element to move the packer element downward to sealingly engage the second seal body with the cylindrical interior surface.

19. The sealing system as defined in claim 18, further comprising:

the first seal body axially supported on a first metal rib extending radially from a metal base; and the second seal body axially supported on a second metal rib extending radially from the metal base.

20. The sealing system as defined in claim 19, wherein at least one of the first rib and the second rib sealingly engages the sealing surface after the second seal body.

21. The sealing system as defined in claim 18, wherein the tool positioner moves the packer element axially relative to a generally stationary wedge ring.

22. The sealing system as defined in claim 18, wherein the second seal body is spaced axially between an upper metal rib and a lower metal rib.

23. The sealing assembly as defined in claim 22, wherein the upper metal rib is downwardly inclined and the lower metal rib is upwardly inclined.

24. The sealing system as defined in claim 18, further comprising:

one or more axially spaced protrusions on a radially inner surface of the metal base each for metal-to-metal sealing engagement with the conical outer surface of the wedge ring.

25. A method as defined in claim 18, wherein each of the first and second seal bodies is axially fixed in at least one direction by the metal base.

26. A method as defined in claim 25, wherein the second seal body as secured axially in both directions to the metal base.

27. A method as defined in claim 25, wherein the base includes radially extending fingers to limit axial movement of each of the first and second seal bodies with respect to the base of at least one direction.

28. A method of sealing with generally interior cylindrical surface of a tubular or a tool, the method comprising:

providing an axially extending annular packer element including a metal base, and a first elastomeric seal body spaced axially from a second seal body, the first seal body having an outer diameter for initially sealing with the cylindrical surface, the second seal body having an elasticity lower than the first seal body, the annular packer element having a reduced diameter initial position and an expanded diameter sealing position;

providing a wedge ring radially inward of the packer element and having a substantially conical outer surface configured to radially expand the packer element to the expanded sealing position upon axial movement of the packer element relative to the wedge ring, such that the second seal body sealingly engages the cylindrical surface; and moving one of the packer element and the wedge ring relative to the other of the packer element and the wedge ring;

initially sealing the first elastomeric seal body with the cylindrical surface; and thereafter sealing the second seal body with the cylindrical surface.

29. The method as defined in claim 28, further comprising:

supporting the first seal body on a first metal rib extending radially from a metal base; and supporting the second seal body on a second metal rib extending radially from the metal base.

30. A method as defined in claim 29, wherein at least one of the first rib and the second rib sealingly engages the sealing surface after the second seal body.

31. The method as defined in claim 28, further comprising:

utilizing hydraulic forces due to the sealing engagement of the first seal body with the cylindrical surface to move the packer element with respect to the wedge ring to move the second seal body into sealing engagement with the interior cylindrical surface.

32. The method as defined in claim 28, further comprising:

forming the second seal body from one of a group consisting of tin, tin alloy, lead, lead alloy, indium, indium alloy, a metal softer than the metal of the base of the packer element, cast iron, plastic, and an elastomer having a substantially lower elasticity than the first seal body.

33. The method as defined in claim 28, further comprising:

positioning the first elastomeric seal body axially below the second seal body, such that fluid pressure above the packer element acts downward on the first seal body to sealingly engage the second seal body with the cylindrical interior surface.

34. The method as defined in claim 28, wherein the packer element is moved axially relative to a generally stationary wedge ring.

35. The method as defined in claim 28, wherein the wedge ring is moved axially relative to a generally stationary packer element.

36. A method as defined in claim 28, further comprising:

axially spacing the second seal body between an upper metal rib and a lower metal rib.

37. The method as defined in claim 36, wherein the upper metal rib is downwardly inclined and the lower metal rib is upwardly inclined.

38. The method as defined in claim 28, further comprising:

providing one or more axially spaced protrusions on a radially inner surface of the metal base each for metal-to-metal sealing engagement with the conical outer surface of the wedge ring.

39. The method as defined in claim 28, wherein the tool is a wellhead assembly with the interior cylindrical surface.

40. A method as defined in claim 28, wherein each of the first and second seal bodies is axially fixed in at least one direction by the metal base.

41. A method as defined in claim 40, wherein the second seal body is secured axially in both directions to the metal base.

42. A method as defined in claim 40, wherein the base includes radially extending fingers to limit axial movement of each of the first and second seal bodies with respect to the base in at least one direction.

* * * * *

UNITED STATES PATENT AND TRADEMARK OFFICE

CERTIFICATE OF CORRECTION

PATENT NO. : 6,705,615 B2
DATED : March 16, 2004
INVENTOR(S) : Lionel J. Milberger et al.

It is certified that error appears in the above-identified patent and that said Letters Patent is hereby corrected as shown below:

Column 9,
Lines 30, 33 and 36, change “A method” to -- The sealing system --.

Column 10,
Line 23, change “The sealing assembly” to -- The sealing system --.
Lines 33, 36 and 39, change “A method” to -- The sealing system --.

Signed and Sealed this

Eighteenth Day of May, 2004

JON W. DUDAS
*Acting Director of the United States Patent and Trademark Office*